US009478923B2

(12) United States Patent
Kao et al.

(10) Patent No.: US 9,478,923 B2
(45) Date of Patent: Oct. 25, 2016

(54) ELECTRICAL PLUG CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Yang-Yang Zhou, New Taipei (TW); Mao-Sheng Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/942,249

(22) Filed: Nov. 16, 2015

(65) Prior Publication Data

US 2016/0141804 A1 May 19, 2016

(30) Foreign Application Priority Data

Nov. 19, 2014 (CN) ..... 2014 1 0661805

(51) Int. Cl.

| | |
|---|---|
| ***H01R 24/60*** | (2011.01) |
| ***H01R 13/6471*** | (2011.01) |
| ***H01R 13/6582*** | (2011.01) |
| ***H01R 13/6585*** | (2011.01) |
| *H01R 13/66* | (2006.01) |

(52) U.S. Cl.

CPC ..... *H01R 24/60* (2013.01); *H01R 13/6471* (2013.01); *H01R 13/6582* (2013.01); *H01R 13/6585* (2013.01); *H01R 13/6658* (2013.01)

(58) Field of Classification Search

USPC ..... 439/607.01, 607.55, 55, 83, 357

See application file for complete search history.

(56) References Cited

U.S. PATENT DOCUMENTS

| | | | | |
|---|---|---|---|---|
| 8,461,465 | B2 * | 6/2013 | Golko | H01R 13/516 174/359 |
| 8,801,462 | B2 * | 8/2014 | Tsai | H01R 12/724 439/607.01 |
| 9,178,319 | B2 * | 11/2015 | Little | H01R 13/6585 |
| 9,312,644 | B2 * | 4/2016 | Kao | H01R 13/6591 |
| 9,337,588 | B2 * | 5/2016 | Chang | H01R 13/6594 |
| 9,350,121 | B2 * | 5/2016 | Ju | H01R 13/6585 |
| 9,350,126 | B2 * | 5/2016 | Little | H01R 24/60 |
| 9,356,400 | B2 * | 5/2016 | Little | H01R 4/023 |
| 9,362,680 | B2 * | 6/2016 | Kao | H01R 13/6583 |
| 9,379,499 | B2 * | 6/2016 | Miyoshi | H01R 24/60 |
| 2009/0156027 | A1 * | 6/2009 | Chen | H01R 13/6485 439/83 |
| 2010/0267261 | A1 * | 10/2010 | Lin | H01R 13/6461 439/218 |
| 2013/0344739 | A1 * | 12/2013 | Shih | H01R 13/658 439/607.28 |

(Continued)

*Primary Examiner* — Alexander Gilman

(74) *Attorney, Agent, or Firm* — Muncy, Geissler, Olds & Lowe, P.C.

(57) ABSTRACT

An electrical plug connector includes a metallic shell, an insulated housing, and a grounding sheet. The insulated housing is received in a receiving cavity of the metallic shell and includes a mating room and side assembling cavities. The side assembling cavities are defined at two sides of the insulated housing and communicate with the mating room. The grounding sheet is at the insulated housing and in contact with the metallic shell. The grounding sheet includes a main body in the insulated housing, side arms extended toward the side assembling cavities from two sides of the main body, hook portions extended toward the mating room from the fronts of the side arms, and mounting legs extended from the rears of the side arms and protruded from the side assembling cavities.

14 Claims, 14 Drawing Sheets

(56) References Cited

U.S. PATENT DOCUMENTS

2014/0113481 A1* 4/2014 Little ..... H01R 13/64
439/374

2015/0044886 A1* 2/2015 Little ..... H01R 12/75
439/55

2015/0072562 A1* 3/2015 Little ..... H01R 13/6658
439/607.55

* cited by examiner

| | | | | | | | | | | | |
|---|---|---|---|---|---|---|---|---|---|---|---|
| GND | RX2+ | RX2− | VBUS | RFU | D− | D+ | CC1 | VBUS | TX1− | TX1+ | GND |
| GND | TX2+ | TX2− | VBUS | CC2 | D+ | D− | RFU | VBUS | RX1− | RX1+ | GND |

151

152

Fig. 4C

ELECTRICAL PLUG CONNECTOR

CROSS-REFERENCES TO RELATED APPLICATIONS

This non-provisional application claims priority under 35 U.S.C. §119(a) on Patent Application No. 201410661805.0 filed in China, P.R.C. on Nov. 19, 2014, the entire contents of which are hereby incorporated by reference.

FIELD OF THE INVENTION

The instant disclosure relates to an electrical connector, and more particular to an electrical plug connector.

BACKGROUND

Currently, the increase in the functionality of various electronic devices is driving the demand for smaller and smaller devices that are easier and more convenient for users to carry and use. This causes many electrical/electronic components within the device to be located closer together. This increases the possibility that various electronic components in the device will suffer from electromagnetic interference (EMI) or radio frequency interference (RFI) either from RF components such as the antenna, microphone components, RF power amplifiers, etc. and subsystems in the device and/or from external sources. The high speed electrical transmission in these devices can produce electromagnetic emissions, which may leak from the connection between the plug connector and its mating connector. These emissions can cause problems in high speed signal transmissions in that they can negatively influence wireless communication between two devices.

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The assembly of existing USB electrical receptacle connector and USB electrical plug connector would suffer from EMI and RFI during signal transmission, which would result in error of signal transmission. Therefore, how to improve the conventional electrical connector becomes an issue and is diligently developed by related personnel.

SUMMARY OF THE INVENTION

In view of this, an exemplary embodiment of the instant disclosure provides an electrical plug connector comprising a metallic shell, an insulated housing, a plurality of upper-row plug terminals, a plurality of lower-row plug terminals, and a grounding sheet. The metallic shell defines a receiving cavity therein. The insulated housing is received in the receiving cavity and comprises an upper portion, a lower portion, a mating room, and a plurality of side assembling cavities. The upper portion has an upper mating face, the lower portion has a lower mating face, and the upper mating face faces the lower mating face. The mating room is defined between the upper portion and the lower portion. The side assembling cavities are defined at the side portions at two sides of the insulated housing and communicate with the mating room. The upper-row plug terminals comprise a plurality of upper differential pairs for signal transmission, at least one power terminal, and at least one ground terminal. The upper-row plug terminals are held in the upper portion of the insulated housing and partly exposed upon the upper mating face of the upper portion. The lower-row plug terminals comprise a plurality of lower differential pairs for signal transmission, at least one power terminal, and at least ground terminal. The lower-row plug terminals are held in the lower portion of the insulated housing and partly exposed upon the lower mating face of the lower portion. The grounding sheet is at the insulated housing and in contact with the metallic shell. The grounding sheet comprises a main body, a plurality of side arms, a plurality of hook portions, and a plurality of mounting legs. The main body is in the insulated housing and located between the upper-row plug terminals and the lower-row plug terminals. The side arms are extended toward the side assembling cavities from two sides of the main body. Each of the hook portions is extended toward the mating room from a front of the corresponding side arm. Each of the mounting legs is extended from a rear of the corresponding side arm and protruded from the corresponding side assembling cavity.

Based on the above, the mating between the side arms of the grounding sheet and the inner wall of the metallic shell improves the fastening between the metallic shell and the grounding sheet. In addition, the mounting legs of the grounding sheet of the electrical plug connector are soldered to the circuit board while the mounting legs of a grounding sheet of the electrical receptacle connector are soldered to a circuit board. Therefore, when the electrical plug connector is inserted into the electrical receptacle connector, a low-impedance grounding path can be effectively established between the metallic shell of the electrical plug connector and the metallic shell of the electrical receptacle connector, thereby benefitting in reducing crosstalk interference, insertion loss, and return loss, and the electromagnetic interference and the radiofrequency interference can be reduced. Moreover, the mounting legs of the grounding sheet of the electrical plug connector are soldered to the circuit board so as to improve the connection between the grounding sheet and the circuit board.

Furthermore, since the upper-row plug terminals and the lower-row plug terminals are arranged upside down, and the pin-assignment of the flexible contact portions of the upper-row plug terminals is left-right reversal with respect to that of the flexible contact portions of the lower-row plug terminals. Accordingly, the electrical plug connector can have a 180 degree symmetrical, dual or double orientation design and pin assignments which enables the plug connector to be inserted into a corresponding receptacle connector in either of two intuitive orientations, i.e. in either upside-up or upside-down directions. Therefore, when the electrical plug connector is inserted into an electrical receptacle connector with a first orientation, the flexible contact portions of the upper-row plug terminals are in contact with upper-row receptacle terminals of the electrical receptacle connector. Conversely, when the electrical plug connector is inserted into the electrical receptacle connector with a second orientation, the flexible contact portions of the lower-row plug terminals are in contact with the upper-row receptacle terminals of the electrical receptacle connector. Note that, the inserting orientation of the electrical plug connector is not limited by the instant disclosure.

Detailed description of the characteristics, and the advantages of the instant disclosure, are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 4C is a schematic configuration diagram of plug terminals of the electrical plug connector shown in FIG. 4B;

DETAILED DESCRIPTION

Figure 1:
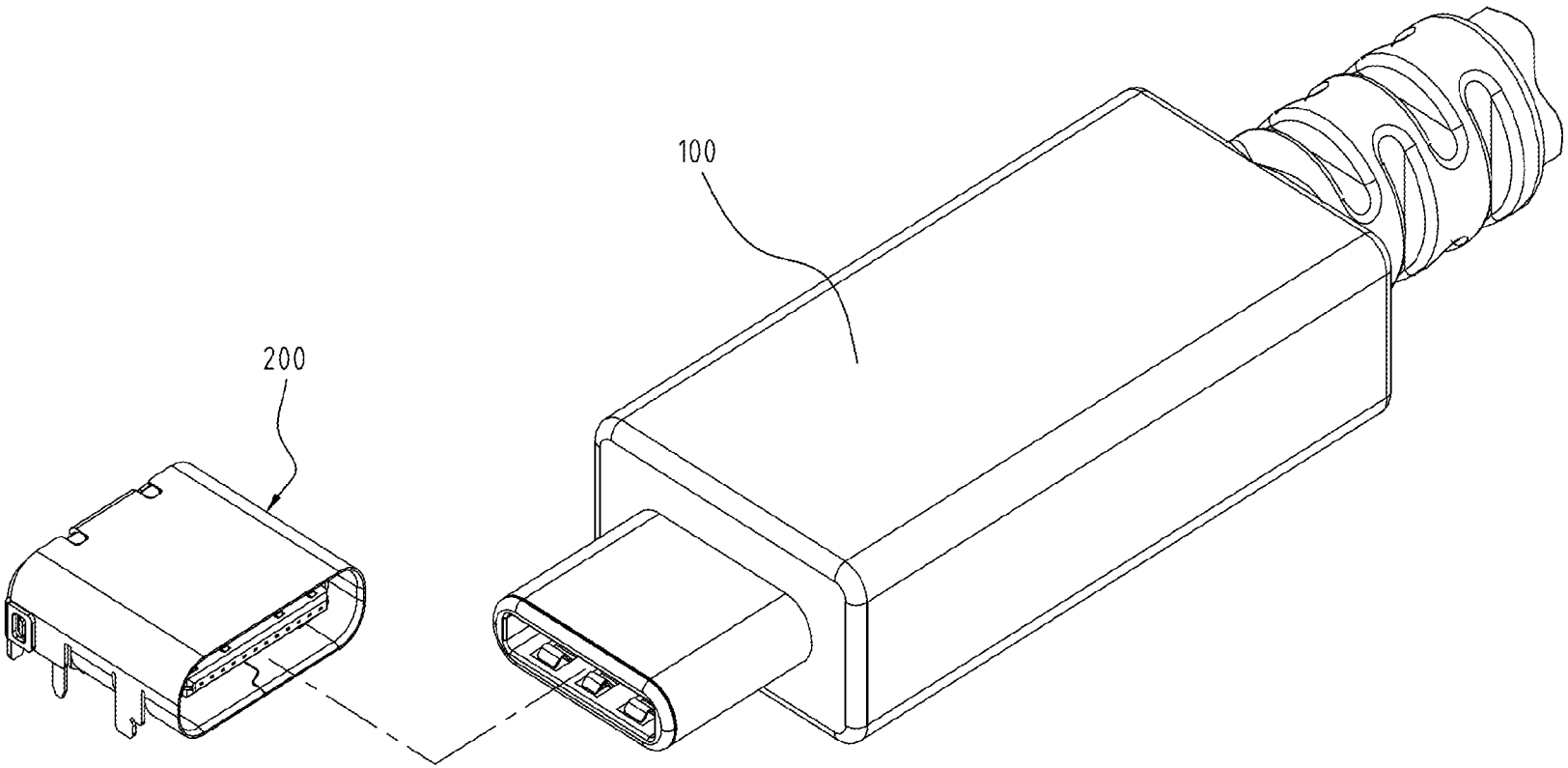
FIG. 1 illustrates an exploded view of an electrical connector assembly according to an exemplary embodiment of the instant disclosure.
Figure 2:
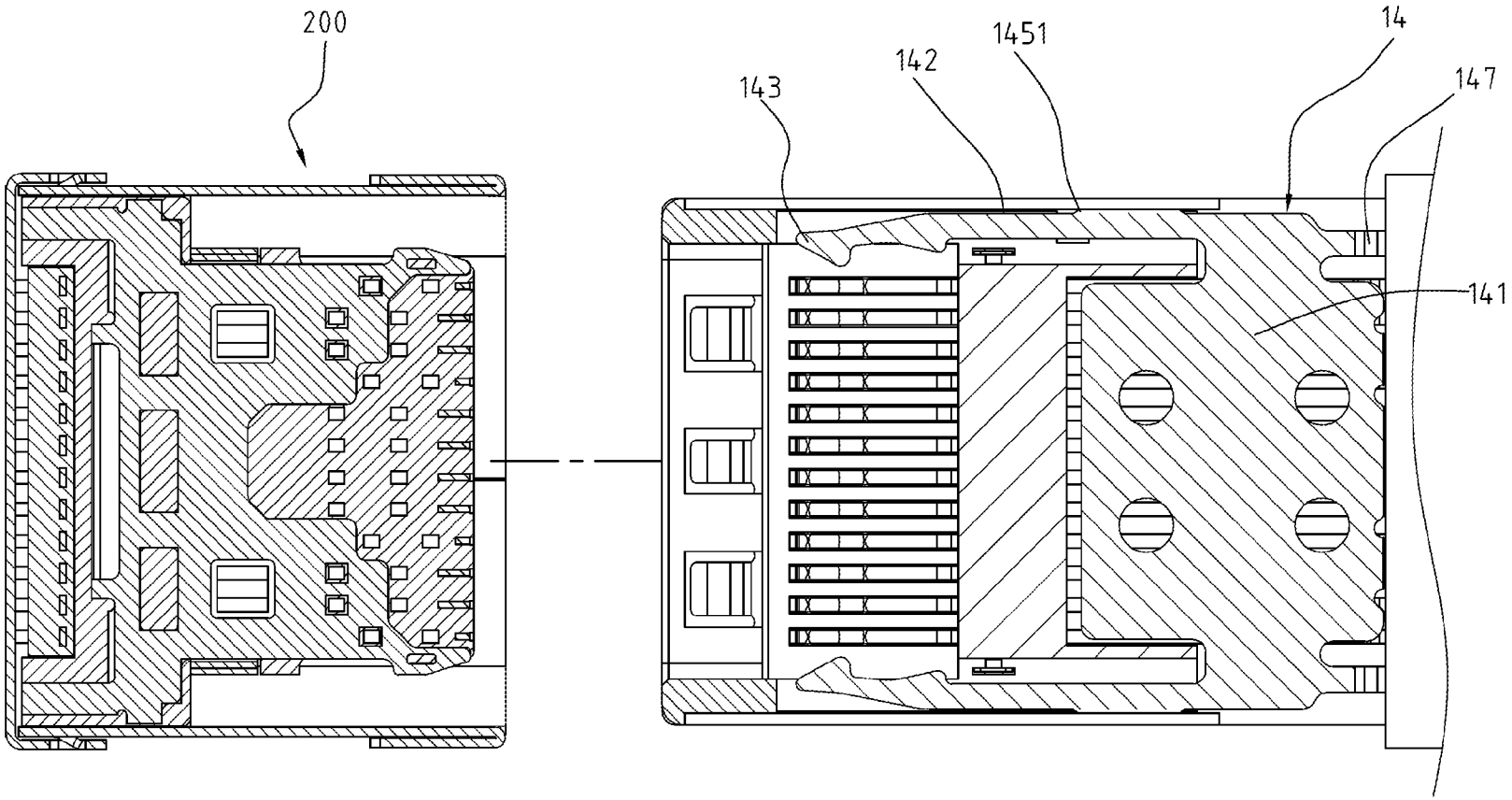
FIG. 2 illustrates an exploded sectional view of the electrical connector assembly shown in FIG. 1.
Figure 3:
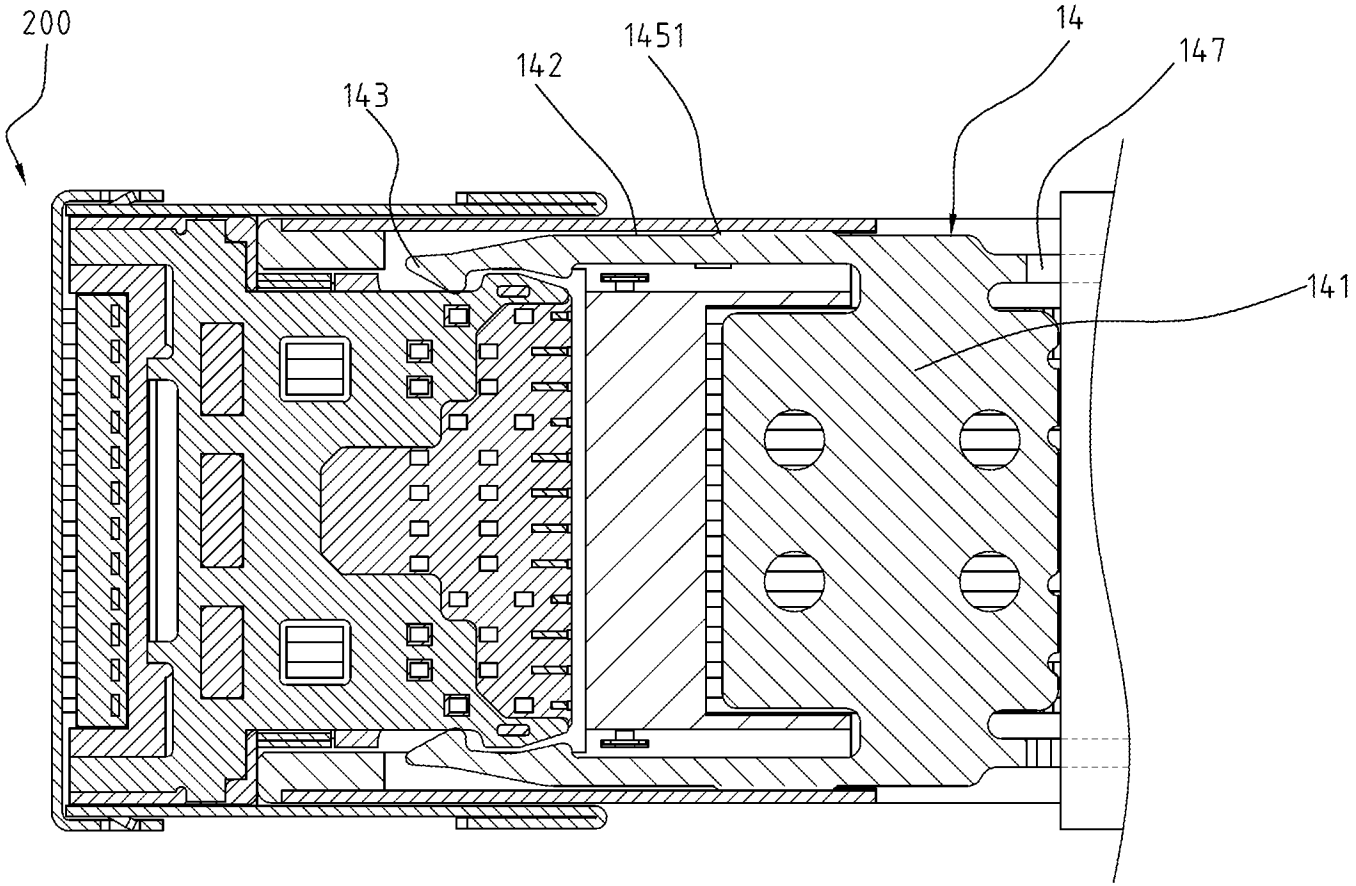
FIG. 3 illustrates an assembled sectional view of the electrical connector assembly shown in FIG. 1 and FIG. 2.

Please refer to FIG. 1 to FIG. 3, which illustrate an electrical connector assembly of an exemplary embodiment according to the instant disclosure. FIG. 1 illustrates an exploded view of an electrical connector assembly of an exemplary embodiment. FIG. 2 illustrates an exploded sectional view of the electrical connector assembly shown in FIG. 1. FIG. 3 illustrates an assembled sectional view of the electrical connector assembly shown in FIG. 1 and FIG. 2. The electrical connector assembly comprises an electrical plug connector 100 and an electrical receptacle connector 200.

Figure 4:
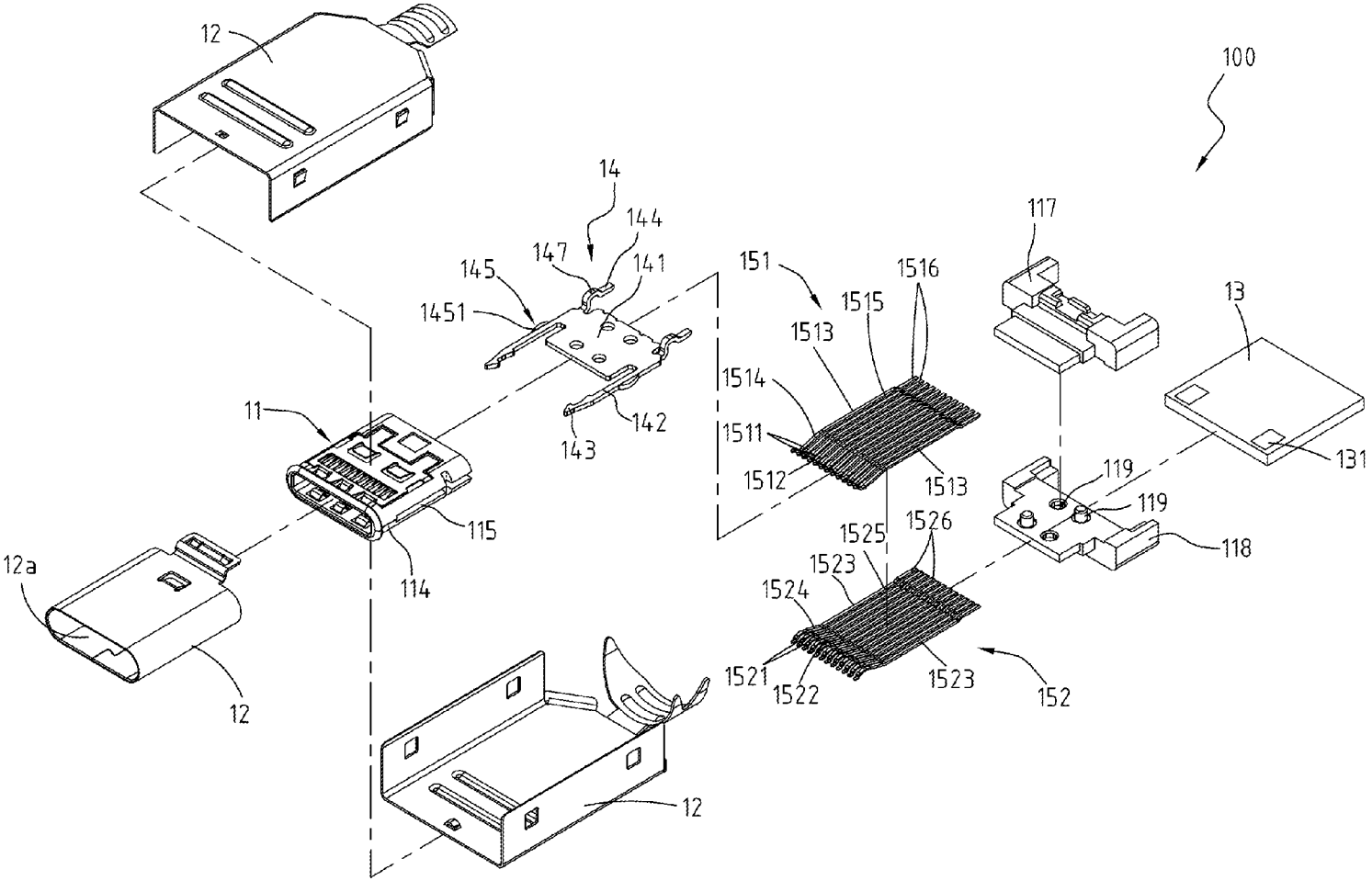
FIG. 4 illustrates an exploded view of an electrical plug connector of the electrical connector assembly shown in FIGS. 1-3.
Figure 5:
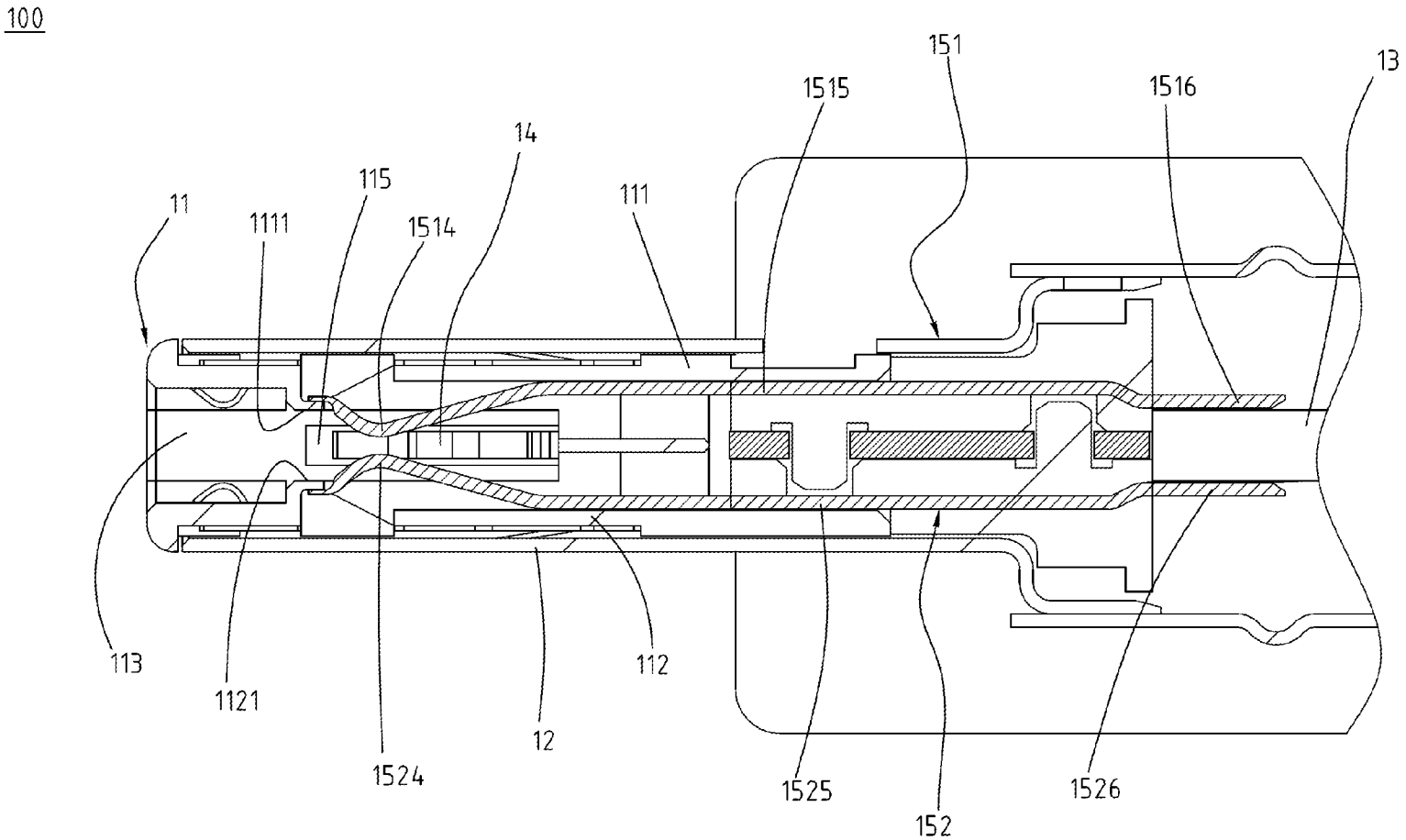
FIG. 5 illustrates a lateral sectional view of the electrical plug connector shown in FIG. 4.
Figure 6:
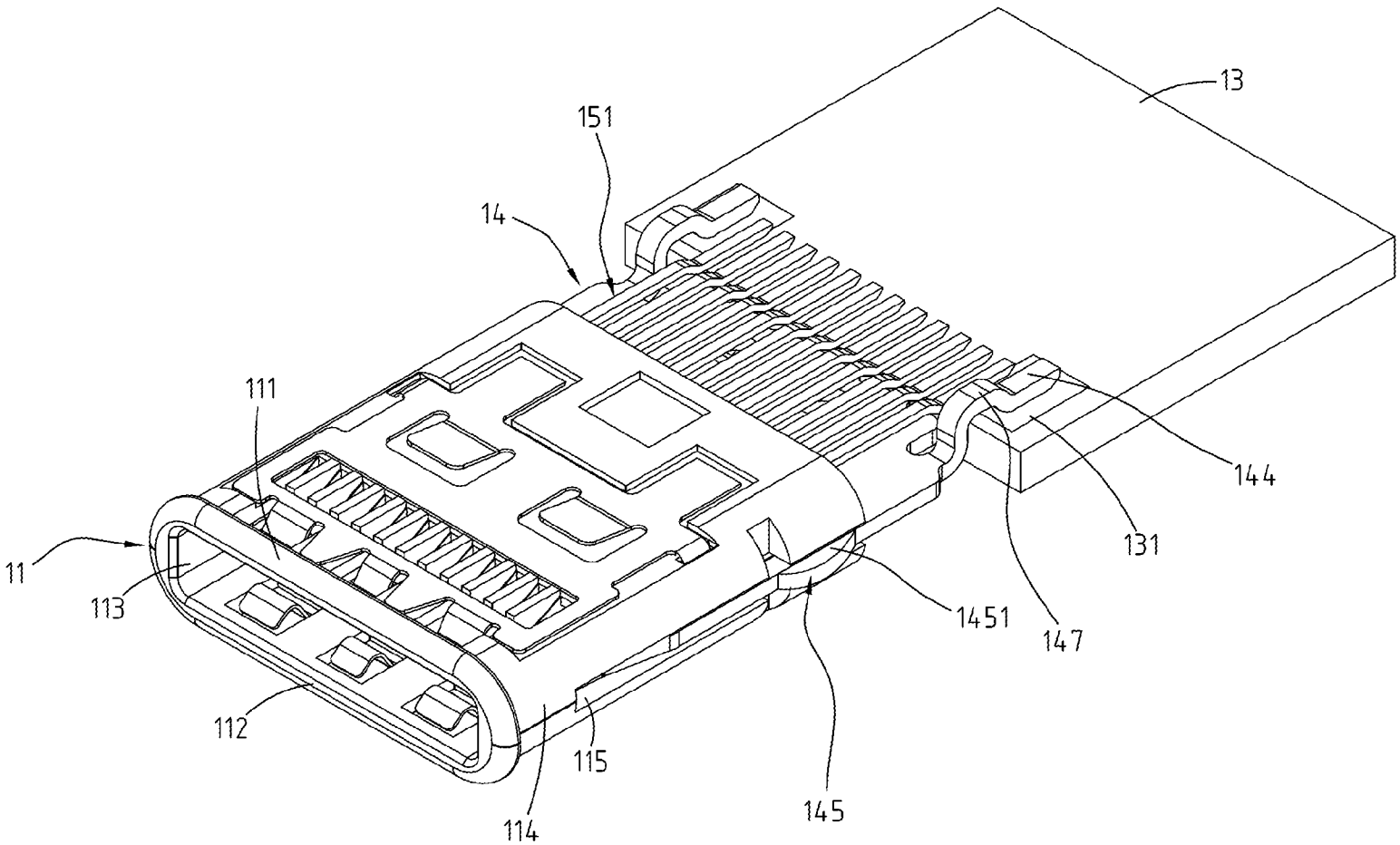
FIG. 6 is a perspective view illustrating a circuit board is assembled with the electrical plug connector of an exemplary embodiment according to the instant disclosure.

Please refer to FIG. 4 to FIG. 6, which illustrate an electrical plug connector 100 of a first exemplary embodiment according to the instant disclosure. In this embodiment, the electrical plug connector 100 can provide a reversible or dual orientation USB Type-C connector interface and pin assignments, i.e., a USB Type-C plug connector. In this embodiment, the electrical plug connector 100 comprises an insulated housing 11, a plurality of plug terminals 15, a metallic shell 12, a circuit board 13, and a grounding sheet 14.

Figure 4A:
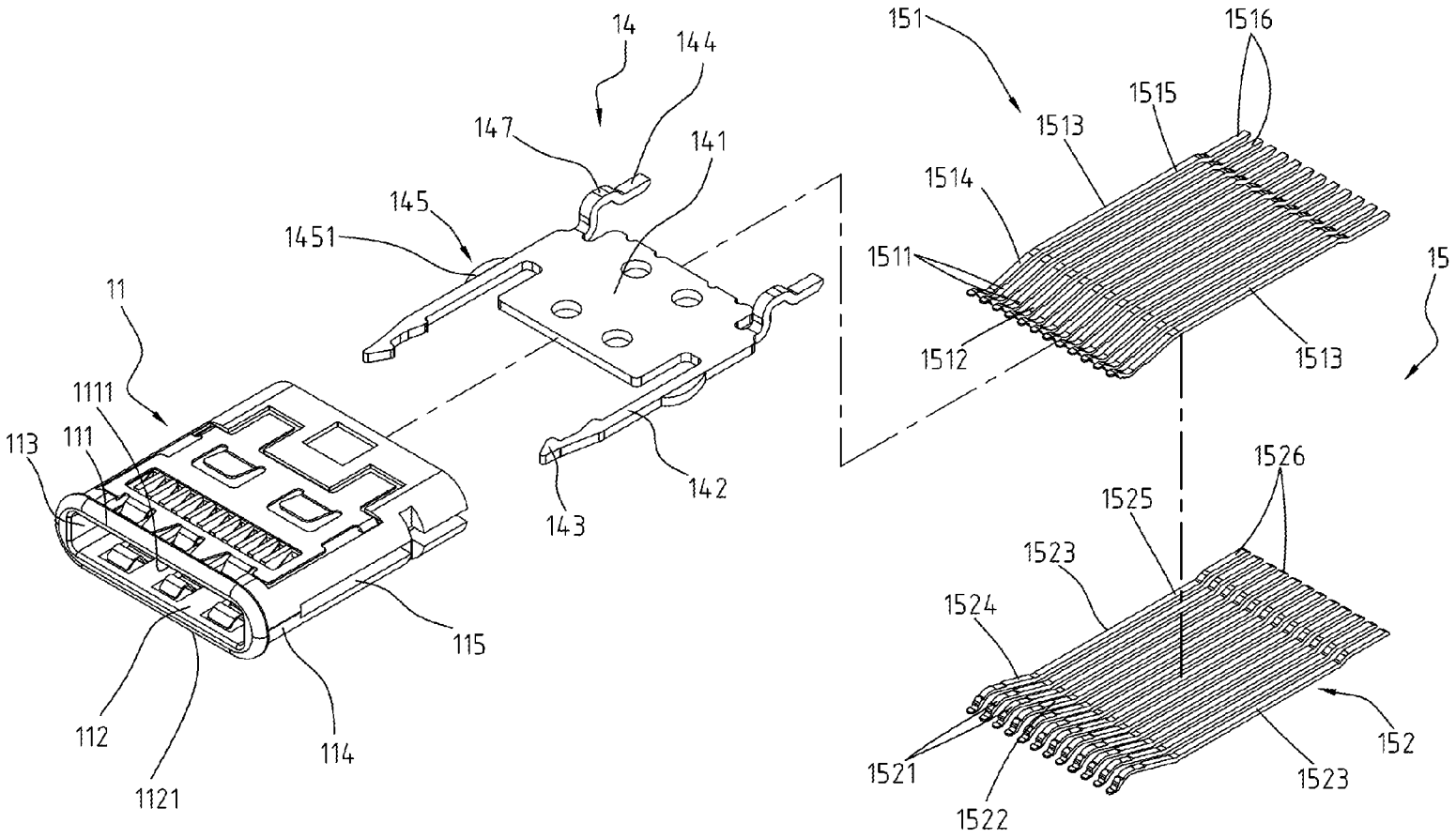
FIG. 4A illustrates a partial exploded view of the electrical plug connector shown in FIG. 4.

Please refer to FIG. 4 to FIG. 6. The insulated housing 11 is an elongate plate and comprises an upper portion 111, a lower portion 112, a mating room 113, a plurality of side portions 114, and a plurality of side assembling cavities 115. Here, the upper portion 111 and the lower portion 112 of the insulated housing 11 are respectively injection molded or the like. The mating room 113 is defined at the front of the insulated housing 11, in other words, the mating room 113 is defined between the upper portion 111 and the lower portion 112. In addition, as shown in FIG. 4D, the insulated housing 11 may further comprise a rear assembling cavity 116 at the rear of the insulated housing 11 and communicating with the mating room 113. The upper portion 111 has an upper mating face 1111, the lower portion 112 has a lower mating face 1121, and the upper mating face 1111 is faced toward the lower mating face 1121. The side portions 114 are located at two sides of the insulated housing 11. Each of the side assembling cavities 115 is defined at the corresponding side portion 114 and formed as an elongate groove. A front end of each of the side assembling cavities 115 is open and communicates with the mating room 113. In other words, the front ends of the side assembling cavities 115 are close to the mating room 113 and communicate with the mating room 113, and rear ends of the side assembling cavities 115 are close to the two sides of the circuit board 13, as shown in FIG. 6.

Please refer to FIG. 4, FIG. 4D, and FIG. 5. The electrical plug connector 100 further comprises an upper base portion 117 and a lower base portion 118 adapted to be assembled with each other. The upper base portion 117 is assembled to the rear of the upper-row plug terminals 151, the lower base portion 118 is assembled to the rear of the lower-row plug terminals 152, and the front of the upper base portion 117 and the front of the lower base portion 118 are received in the rear assembling cavities 116. In addition, a main body 141 of the grounding sheet 14 is located between the upper base portion 117 and the lower base portion 118. Here, the upper base portion 117 and the lower base portion 118 are assembled with each other, and several fastening members 119 are respectively provided on the upper base portion 117 and the lower base portion 118. Besides, the main body 141 of the grounding sheet 14 defines through holes thereon for mating with the fastening members 119, such that the main body 141 of the grounding sheet 14 is retained between the upper base portion 117 and the lower base portion 118.

Figure 4B:
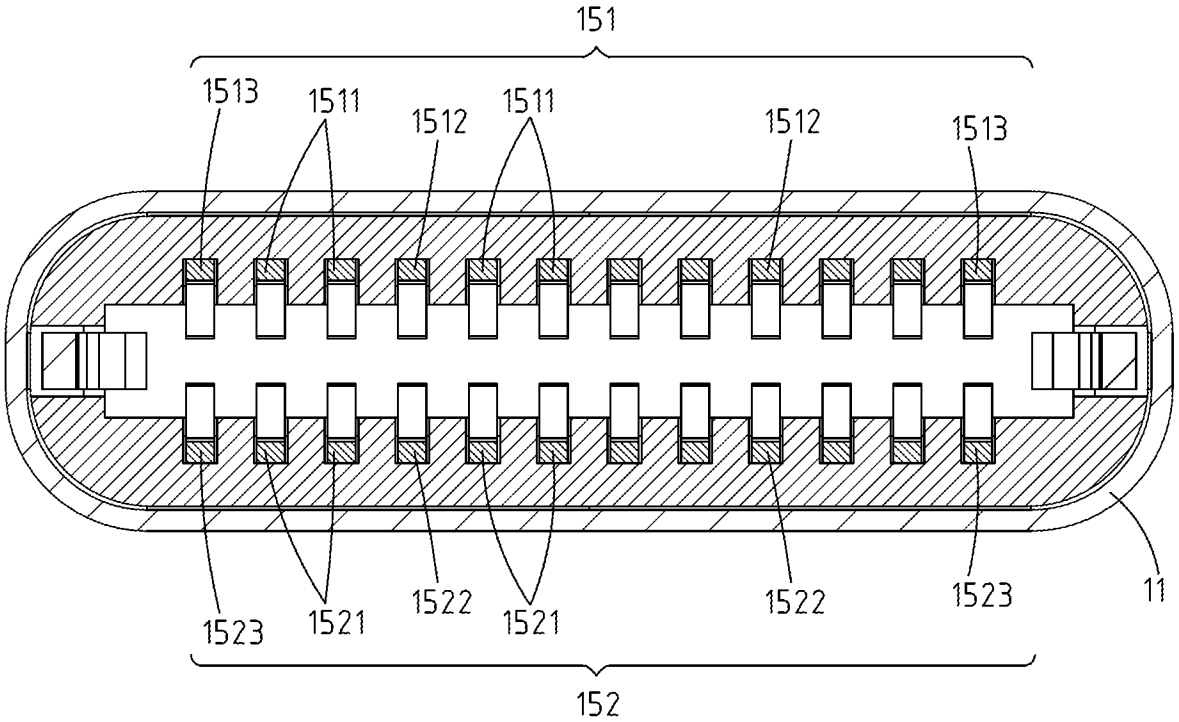
FIG. 4B illustrates a sectional view of the electrical plug connector shown in FIG. 4.
Figure 4D:
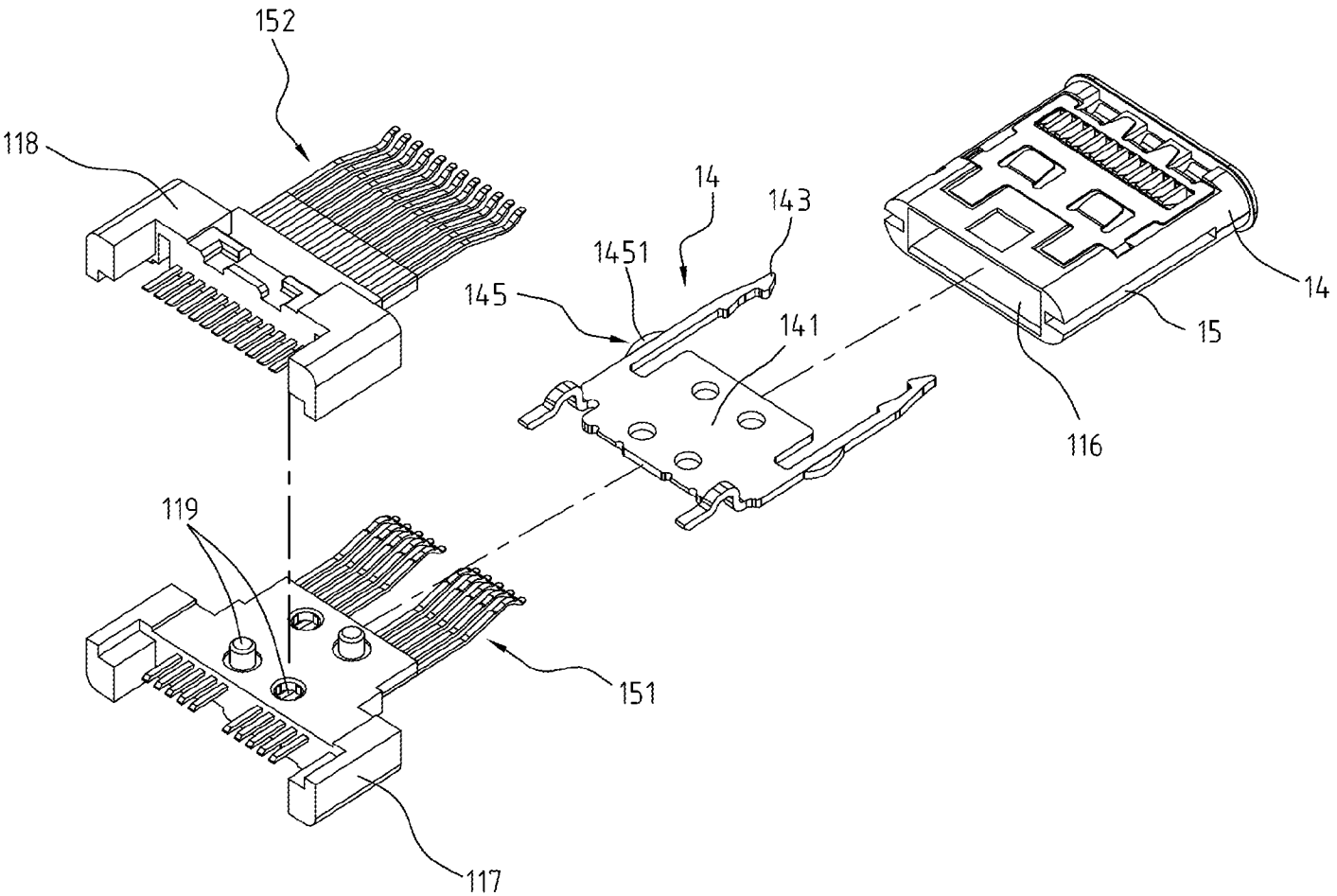
FIG. 4D illustrates an exploded view of the electrical plug connector according to one embodiment of the instant disclosure.

Please refer to FIG. 4B and FIG. 5. The plug terminals 15 are configured in the upper portion 111 and the lower portion 112. The plug terminals 15 comprise a plurality of upper-row plug terminals 151 and a plurality of lower-row plug terminals 152.

Please refer to FIG. 4A, FIG. 4B, and FIG. 4C. The upper-row plug terminals 151 are held in the upper portion 111 of the insulated housing 11 and partly exposed upon the upper mating face 1111 of the upper portion 111. Here, the upper-row plug terminals 151 comprise a plurality of upper differential pairs 1511 for signal transmission, at least one power terminal 1512, and at least one ground terminal 1513. Specifically, the upper-row plug terminals 151 comprise, from right to left, a ground terminal 1513 (Gnd), a first upper differential pair (TX1+−) 1511, a second upper differential pair (D+−) 1511, a third upper differential pair (RX2+−) 1511, two power terminals 1512 (Power/VBUS) between the three pairs of upper differential pairs 1511, a retain terminal (RFU), (the retain terminal and a configuration channel 1 (CC1) are respectively arranged between the power terminals 1512 and the second upper differential pair (D+−) 1511), and a ground terminal 1513 (Gnd) at the leftmost.

Please refer to FIG. 4A, FIG. 4B, and FIG. 4C. Each of the upper-row plug terminals 151 comprises a flexible contact portion 1514, a body portion 1515, and a tail portion 1516. For each of the upper-row plug terminals 151, the body portion 1515 is held in the upper portion 111, the flexible contact portion 1514 is extended forward from the body portion 1515 in the rear-to-front direction and partly exposed upon the upper mating face 1111 of the upper portion 111, and the tail portion 1516 is extended backward from the body portion 1515 in the front-to-rear direction and protruded from the insulated housing 11. The upper differential pairs 1511 partly project into the mating room 113 and are provided for transmitting first signals (i.e., USB 3.0 signals.). The tail portions 1516 of the upper-row plug terminals 151 are extended from the rear of the insulated housing 11 and aligned horizontally to form flat legs, named SMT legs which can be soldered or mounted on the surface of a circuit board using surface mount technology, as shown in FIG. 4A.

Please refer to FIG. 4A, FIG. 4B, and FIG. 4C. The lower-row plug terminals 152 are held in the lower portion 112 of the insulated housing 11 and partly exposed upon the lower mating face 1121 of the lower portion 112. Here, the lower-row plug terminals 152 comprise a plurality of lower differential pairs 1521 for signal transmission, at least one power terminal 1522, and at least one ground terminal 1523. Specifically, the lower-row plug terminals 152 comprise, from left to right, a ground terminal 1523 (Gnd), a first lower differential pair (TX2+−) 1521, a second lower differential pair (D+−) 1521, a third lower differential pair (RX1+−) 1521, two power terminals 1522 (Power/VBUS) between the three pairs of lower differential pairs 1521, a retain terminal (RFU), (the retain terminal and a configuration channel 2 (CC2) are respectively arranged between the power terminals 1522 and the second lower differential pair (D+−) 1521), and a ground terminal 1523 (Gnd) at the rightmost.

Please refer to FIG. 4A, FIG. 4B, and FIG. 4C. Each of the lower-row plug terminals 152 comprises a flexible contact portion 1524, a body portion 1525, and a tail portion 1526. For each of the lower-row plug terminals 152, the body portion 1525 is held in the lower portion 112, the flexible contact portion 1524 is extended forward from the body portion 1525 in the rear-to-front direction and partly exposed upon the lower mating face 1121 of the lower portion 112, and the tail portion 1526 is extended backward from the body portion 1525 in the front-to-rear direction and protruded from the insulated housing 11. The lower differential pairs 1521 partly project into the mating room 113 and are provided for transmitting second signals (i.e., USB 3.0 signals). The tail portions 1526 of the lower-row plug terminals 152 are extended from the rear of the insulated housing 11 and aligned horizontally to form flat legs, named SMT legs which can be soldered or mounted on the surface of a circuit board using surface mount technology, as shown in FIG. 4A.

Please refer to FIG. 4A, FIG. 4B, and FIG. 4C. It is understood that the upper-row plug terminals 151 and the lower-row plug terminals 152 are respectively at the upper mating face 1111 of the upper portion 111 and the lower mating face 1121 of the lower portion 112. Additionally, pin-assignments of the upper-row plug terminals 151 and the lower-row plug terminals 152 are point-symmetrical with a central point of a receiving cavity 12*a* of the metallic shell 12 as the symmetrical center. Here, point-symmetry means that after the upper-row plug terminals 151 (or the lower-row plug terminals 152), are rotated by 180 degrees with the symmetrical center as the rotating center, the upper-row plug terminals 151 and the lower-row plug terminals 152 are overlapped. That is, the rotated upper-row plug terminals 151 are arranged at the position of the original lower-row plug terminals 152, and the rotated lower-row plug terminals 152 are arranged at the position of the original upper-row plug terminals 151. Accordingly, the electrical plug connector 100 can have a 180 degree symmetrical, dual or double orientation design and pin assignments which enables the electrical plug connector 100 to be inserted into a corresponding receptacle connector in either of two intuitive orientations, i.e. in either upside-up or upside-down directions. In other words, the upper-row plug terminals 151 and the lower-row plug terminals 152 are arranged upside down, and the pin assignment of the upper-row plug terminals 151 is left-right reversal with respect to that of the lower-row plug terminals 152. Accordingly, the electrical plug connector 100 is inserted into an electrical receptacle connector with a first orientation where the lower mating face 1121 of the lower portion 112 is facing up, for transmitting first signals. Conversely, the electrical plug connector 100 is inserted into the electrical receptacle connector with a second orientation where the lower mating face 1121 of the lower portion 112 is facing down, for transmitting second signals. Furthermore, the specification for transmitting the first signals is conformed to the specification for transmitting the second signals. Note that, the inserting orientation of the electrical plug connector 100 is not limited by the instant disclosure.

Please refer to FIG. 4A, FIG. 4B, and FIG. 4C. The position of the upper-row plug terminals 151 correspond to the position of the lower-row plug terminals 152.

Please refer to FIG. 4 and FIG. 5. The metallic shell 12 defines a receiving cavity 12*a* therein. The receiving cavity 12*a* is adapted to receive and enclose the insulated housing 11. In this embodiment, the metallic shell 12 is a multi-piece member, but embodiments are not limited thereto. Alternatively, the metallic shell 12 may be formed by bending a unitary member.

Please refer to FIG. 4 and FIG. 5. The circuit board 13 is located at the rear of the insulated housing 11. The circuit board 13 comprises a plurality of ground contacts 131 and a plurality of terminal contacts (not shown). The ground contacts 131 and the terminal contacts are configured at the circuit board 13 and near to the plug terminals 15. The terminal contacts are located between the ground contacts 131 and in contact with the plug terminals 15.

Please refer to FIG. 4 and FIG. 5. The grounding sheet 14 is formed by a blanking process, but embodiments are not limited thereto. Alternatively, the grounding sheet 14 may be formed by a stamping process. It is understood that the structural strength of the grounding sheet 14 formed by blanking process is greater than that of the grounding sheet 14 formed by stamping process. The grounding sheet 14 is at the insulated housing 11 and in contact with the metallic shell 12. The grounding sheet 14 comprises a main body 141, a plurality of side arms 142, a plurality of hook portions 143, and a plurality of mounting legs 144.

The main body 141 is in the insulated housing 11, namely, the main body 141 is held in the rear assembling cavity 116 of the insulated housing 11. In addition, the main body 141 is located between the upper-row plug terminals 151 and the lower-row plug terminals 152, such that the main body 141 of the grounding sheet 14 can reduce the interference between the upper-row plug terminals 151 and the lower-row plug terminals 152. The side arms 142 are of elongated shape. The side arms 142 are, respectively, extended toward the side assembling cavities 115 from two sides of the main body 141 and held in the side assembling cavities 115. The hook portions 143 are extended toward the mating room 113 from fronts of respective side arms 142 (i.e., each of the hook portions 143 is extended toward the mating room 113 from a front of the corresponding side arm 142), such that the tips of the hook portions 143 are located in the mating room 113. The mounting legs 144 are extended from rears of the respective side arms 142 (i.e., each of the mounting legs 144 is extended from a rear of the corresponding side arm 142). Each of the mounting legs 144 is protruded from the rear end of the corresponding side assembling cavity 115 and exposed upon the insulated housing 11. The mounting legs 144 are further extended toward the circuit board 13 and soldered with the ground contacts 131.

Figure 4E:
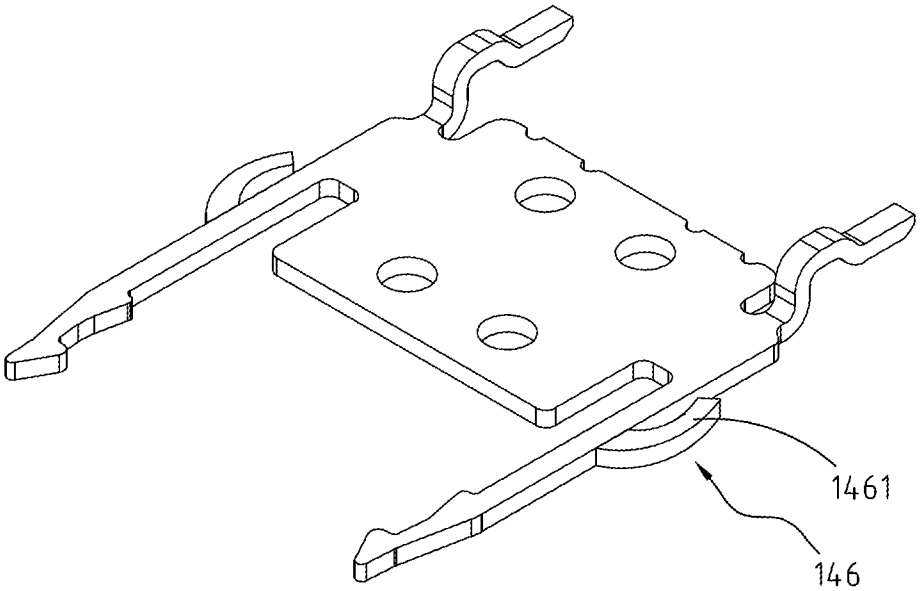
FIG. 4E illustrates a perspective view of a grounding sheet of the electrical plug connector according to one embodiment of the instant disclosure.
Figure 9:
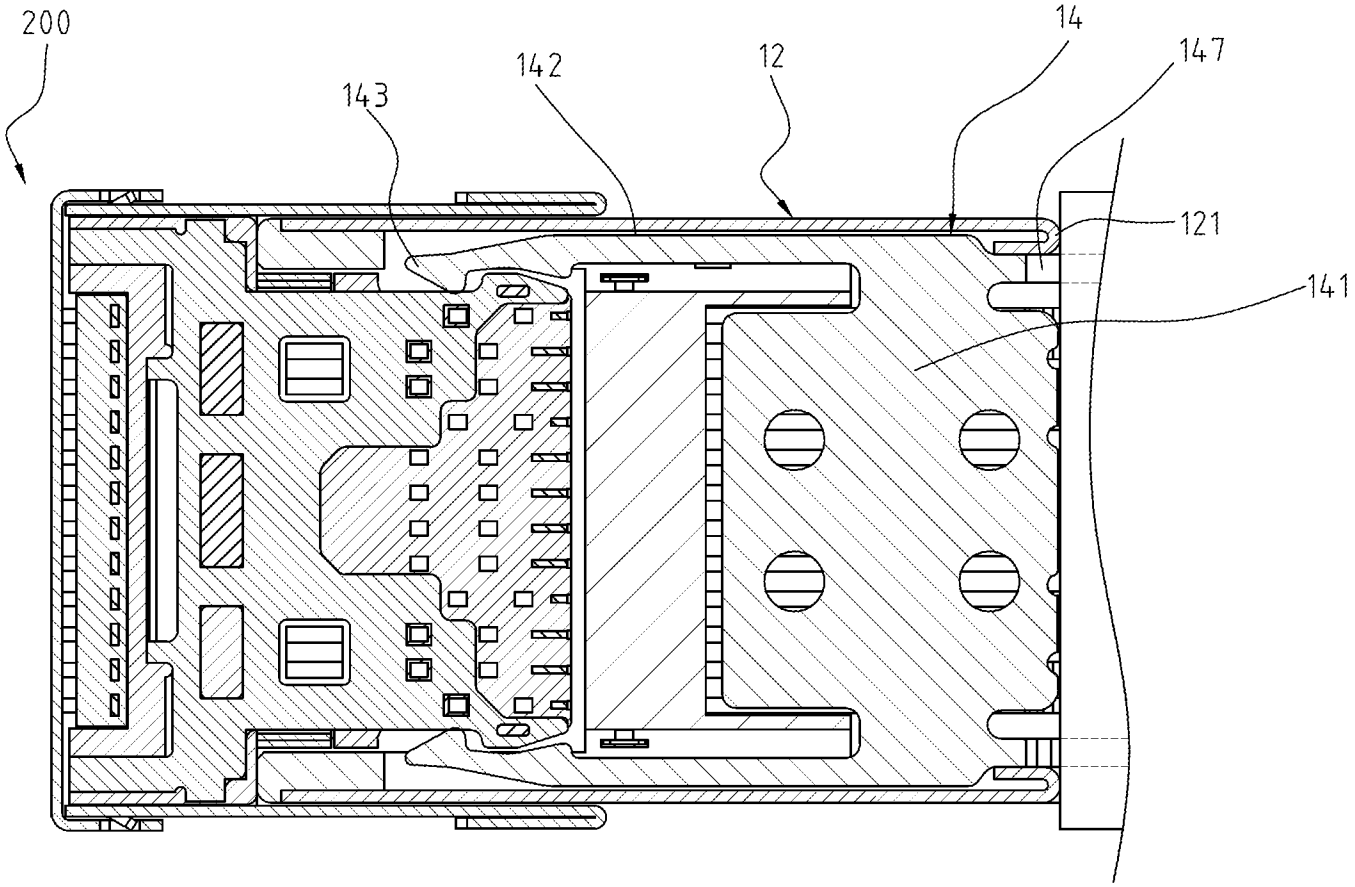
FIG. 9 is a schematic sectional view illustrating the circuit board is assembled with the metallic shell of the electrical receptacle connector through the grounding sheet according to another embodiment of the instant disclosure.

The grounding sheet 14 further comprises a plurality of protruded portions 145 each formed at a side portion of the corresponding side arm 142 and in contact with the inner wall of the metallic shell 12. Here, the protruded portions 145 are solid blocks 1451 protruded from the respective side arms 142. The solid blocks 1451 are arc shaped and provided for contacting the inner wall of the metallic shell 12. Alternatively, in some embodiments, instead of the protruded portion 145, the grounding sheet 14 may comprise a plurality of elastic portions 146 each formed at the side portion of the corresponding side arm 142 and in contact with the inner wall of the metallic shell 12, as shown in FIG. 4D and FIG. 4E. Here, the elastic portions 146 are elastic arms 1461 protruded from the respective side arms 142, and the elastic arms 1461 are arc shaped. In practice, the elastic arms 1461 are abutted against the inner wall of the metallic shell 12 and the elastic arms 1461 can be moved resiliently. The difference between the protruded portions 145 and the elastic portions 146 is that, the protruded portions 145 are relatively inelastically and firmly in contact with the metallic shell 12 while the elastic portions 146 are relatively elastically and firmly in contact with the metallic shell 12, such that the elastic portions 146 may move resiliently when an external force is applied to. Besides, in some embodiments, the grounding sheet 14 is devoid of the protruded portions 145 and the elastic portions 146, and the grounding sheet 14 is in contact with the metallic shell 12 by other means. Specifically, as shown in FIG. 9, a plurality of extension plates 121 is extended bilaterally from the rear of the metallic shell 12 and in contact with the grounding sheet 14 which is devoid of the protruded portions 145 and the elastic portions 146. Therefore, the extension plates 121 are adapted to be in contact with the mounting legs 144 or other parts of the grounding sheet 14 to allow the contact between the grounding sheet 14 and the metallic shell 12.

Please refer to FIG. 1 and FIG. 4, in practice, the circuit board 13 is assembled to the rear of the insulated housing 11 and parallel aligned to the length direction of the insulated housing 11, so that wires may be soldered to the circuit board 13 to allow the connector to be parts of a data transmission cable. Alternatively, the wires may be, but not limited to, omitted to allow the connector to be parts of a flash disk. In some embodiments, the circuit board 13 is perpendicularly connected to the rear of the insulated housing 11. In other words, the electrical plug connector 100 can be assembled with the circuit board 13, so that the assembly between the insulated housing 11, the metallic shell 12, and the circuit board 13 is formed as a standing charging dock.

Figure 7:
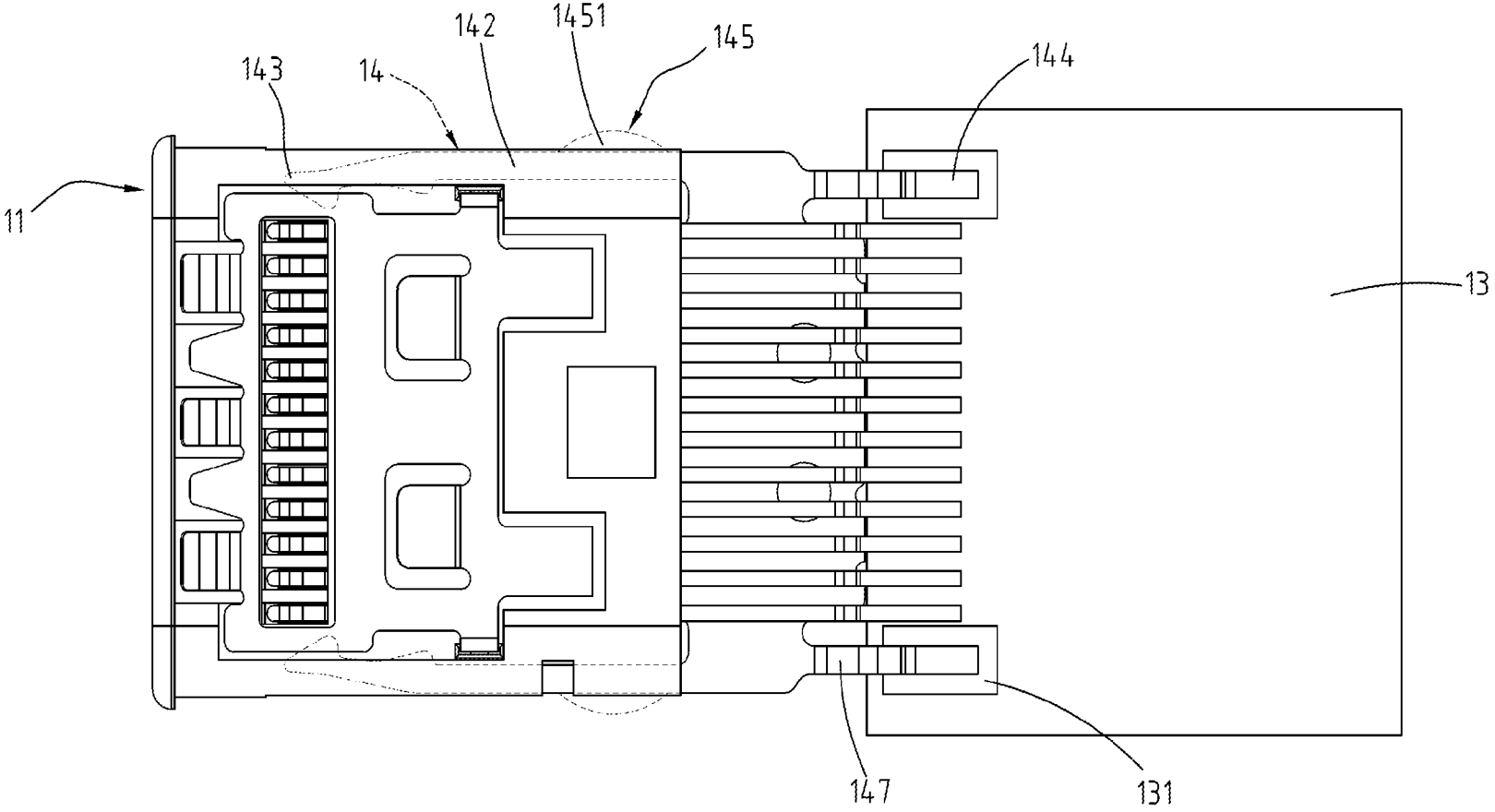
FIG. 7 is a top view illustrating the circuit board is assembled with the electrical plug connector of an exemplary embodiment according to the instant disclosure.

Please refer to FIG. 5, FIG. 6, and FIG. 7. The ground contacts 131 are located at the surface of the circuit board 13, and the mounting legs 144 of the grounding sheet 14 are formed as SMT (Surface Mount technology) legs and soldered to the ground contacts 131, but embodiments are not limited thereto. Alternatively, the mounting legs 144 of the grounding sheet 14 may be formed as through-hole legs. The circuit board 13 defines a plurality of via holes thereon for holding the through-hole legs, and the ground contacts 131 are located at the via holes. That is, the mounting legs 144 of the grounding sheet 14 may pass through the via holes and be soldered with the ground contacts 131 via soldering means.

Please refer to FIG. 4 and FIG. 5. The grounding sheet 14 further comprises a plurality of bending portions 147 respectively extended toward the mounting legs 144 from two sides of the rear of the main body 141. The side arms 142 and the mounting legs 144 are not aligned at the same level. In other words, the positions of the mounting legs 144 can be adjusted by the bending portions 147, such that the mounting legs 144 are capable of being positioned to the ground contacts 131 of the circuit board 13.

Figure 8:
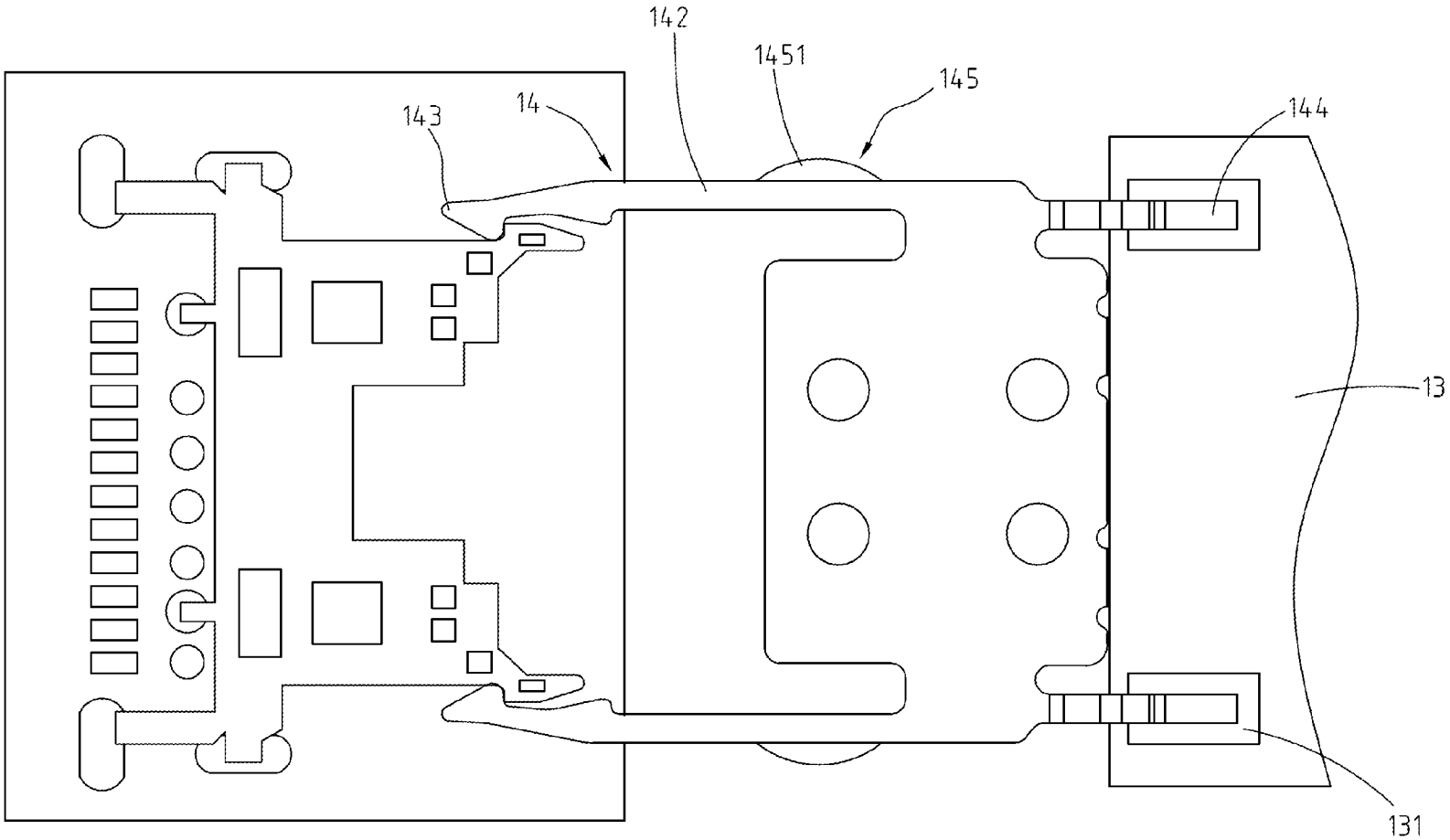
FIG. 8 is a schematic sectional view illustrating the circuit board is assembled with a metallic shell of an electrical receptacle connector through the grounding sheet according to one embodiment of the instant disclosure.

As shown in FIG. 3 and FIG. 8, when the electrical plug connector 100 is mated with the electrical receptacle connector 200, the hook portions 143 of the grounding sheet 14 are engaged with engaging portions of a grounding sheet of the electrical receptacle connector 200, so that the hook portions 143 would not wear against two sides of a tongue portion of the electrical receptacle connector 200 and the tongue portion would not be damaged. Additionally, receptacle terminals of the electrical receptacle connector 200 are partly exposed and in contact with the metallic shell 12 of the electrical receptacle connector 200), and the grounding sheet of the electrical receptacle connector 200 is also provided for noise conduction and grounding of the electrical receptacle connector 200.

In the electrical plug connector 100, the protruded portions 145 or the elastic portions 146 of the grounding sheet 14 are in contact with the metallic shell 12, and the mounting legs 144 of the grounding sheet 14 are soldered to the circuit board 13. In the electrical receptacle connector 200, mounting legs of the grounding sheet are soldered to a circuit board. Accordingly, a low-impedance grounding path can be effectively established between the metallic shell 12 of the electrical plug connector 100 and the metallic shell of the electrical receptacle connector 200 when the electrical plug connector 100 is mated with the electrical receptacle connector 200, such that the electromagnetic interference and the radiofrequency interference can be reduced.

Based on the above, the mating between the side arms of the grounding sheet and the inner wall of the metallic shell improves the fastening between the metallic shell and the grounding sheet. In addition, the mounting legs of the grounding sheet of the electrical plug connector are soldered to the circuit board, while the mounting legs of a grounding sheet of the electrical receptacle connector are soldered to a circuit board. Therefore, when the electrical plug connector is inserted into the electrical receptacle connector, a low-impedance grounding path can be effectively established between the metallic shell of the electrical plug connector and the metallic shell of the electrical receptacle connector, thereby benefitting in reducing crosstalk interference, insertion loss, and return loss, and the electromagnetic interference and the radiofrequency interference can be reduced. Moreover, the mounting legs of the grounding sheet of the electrical plug connector are soldered to the circuit board so as to improve the connection between the grounding sheet and the circuit board.

Furthermore, since the upper-row plug terminals and the lower-row plug terminals are arranged upside down, and the pin-assignment of the flexible contact portions of the upper-row plug terminals is left-right reversal with respect to that of the flexible contact portions of the lower-row plug terminals. Accordingly, the electrical plug connector can have a 180 degree symmetrical, dual or double orientation design and pin assignments which enables the plug connector to be inserted into a corresponding receptacle connector in either of two intuitive orientations, i.e. in either upside-up or upside-down directions. Therefore, when the electrical plug connector is inserted into an electrical receptacle connector with a first orientation, the flexible contact portions of the upper-row plug terminals are in contact with upper-row receptacle terminals of the electrical receptacle connector. Conversely, when the electrical plug connector is inserted into the electrical receptacle connector with a second orientation, the flexible contact portions of the lower-row plug terminals are in contact with the upper-row receptacle terminals of the electrical receptacle connector. Note that, the inserting orientation of the electrical plug connector is not limited by the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell, defining a receiving cavity therein;

an insulated housing, received in the receiving cavity, the insulated housing comprising an upper portion, a lower portion, a mating room, and a plurality of side assembling cavities, wherein the upper portion has an upper mating face, the lower portion has a lower mating face, the upper mating face is faced toward the lower mating face, the mating room is defined between the upper portion and the lower portion, and the side assembling cavities are defined at two sides of the insulated housing and communicate with the mating room;

a plurality of upper-row plug terminals, held in the insulated housing and located upon the upper mating face of the upper portion, wherein the upper-row plug terminals comprise a plurality of pairs of upper differential pairs for signal transmission, at least one power terminal, and at least one ground terminal;

a plurality of lower-row plug terminals, held in the insulated housing and located upon the lower mating face of the lower portion, wherein the lower-row plug terminals comprise a plurality of pairs of lower differential pairs for signal transmission, at least one power terminal, and at least one ground terminal; and a grounding sheet at the insulated housing and in contact with the metallic shell, the grounding sheet comprising:

a main body in the insulated housing and located between the upper-row plug terminals and the lower-row plug terminals;

a plurality of side arms respectively extended toward the side assembling cavities from two sides of the main body;

a plurality of hook portions, each extended toward the mating room from a front of the corresponding side arm; and a plurality of mounting legs, each extended backward from a rear of the corresponding side arm and exposed from the corresponding side assembling cavity.

2. The electrical plug connector according to claim 1, wherein the insulated housing defines a rear assembling cavity at the rear of the insulated housing, and the rear assembling cavity communicates with the mating room.

3. The electrical plug connector according to claim 2, further comprising an upper base portion and a lower base portion, the upper base portion is assembled to the rear of the upper-row plug terminals, the lower base portion is assembled to the rear of the lower-row plug terminals, and the front of the upper base portion and the front of the lower base portion are received in the rear assembling cavity.

4. The electrical plug connector according to claim 3, wherein the main body of the grounding sheet is located between the upper base portion and the lower base portion.

5. The electrical plug connector according to claim 1, wherein the grounding sheet comprises a plurality of protruded portion, each of the protruded portions is formed at a side portion of the corresponding side arm and in contact with the inner wall of the metallic shell.

6. The electrical plug connector according to claim 5, wherein each of the protruded portions is a solid block protruded from the corresponding side arm, and the solid blocks are arc shaped.

7. The electrical plug connector according to claim 1, wherein the grounding sheet comprises a plurality of elastic portions, each of the elastic portions is formed at a side portion of the corresponding side arm and in contact with the inner wall of the metallic shell.

8. The electrical plug connector according to claim 7, wherein each of the elastic portions is an elastic arm protruded from the corresponding side arm, and the elastic arms are arc shaped.

9. The electrical plug connector according to claim 1, wherein the metallic shell comprises a plurality of extension plates extended toward the grounding sheet and in contact with the grounding sheet.

10. The electrical plug connector according to claim 1, wherein the grounding sheet comprises a plurality of bending portions respectively extended toward the mounting legs from two sides of the main body.

11. The electrical plug connector according to claim 1, further comprising a circuit board at the rear of the insulated housing, wherein the circuit board comprises a plurality of ground contacts, the mounting legs are extended and connected to the ground contacts, and the circuit board is parallel aligned to the length direction of the insulated housing.

12. The electrical plug connector according to claim 1, wherein each of the upper-row plug terminals comprises a flexible contact portion, a body portion, and a tail portion, wherein the body portion is held in the upper portion, the flexible contact portion is extended forward from the body portion in the rear-to-front direction and partly exposed upon the upper mating face of the upper portion, and the tail portion is extended backward from the body portion in the front-to-rear direction and protruded from the insulated housing.

13. The electrical plug connector according to claim 1, wherein each of the lower-row plug terminals comprises a flexible contact portion, a body portion, and a tail portion, wherein the body portion is held in the lower portion, the flexible contact portion is extended forward from the body portion in the rear-to-front direction and partly exposed upon the lower mating face of the lower portion, and the tail portion is extended backward from the body portion in the front-to-rear direction and protruded from the insulated housing.

14. The electrical plug connector according to claim 1, wherein the upper-row plug terminals and the lower-row plug terminals have 180 degree symmetrical design with respect to a central point of the receiving cavity as the symmetrical center.

* * * * *